US011332858B2

(12) United States Patent
Rockstroh et al.

(10) Patent No.: US 11,332,858 B2
(45) Date of Patent: May 17, 2022

(54) FLAT-KNITTED MATERIAL IN THE FORM OF A PANTS PART COMPRISING THE SEAT

(71) Applicant: medi GmbH & Co. KG, Bayreuth (DE)

(72) Inventors: Martin Rockstroh, Creussen (DE); Alexandra Herold-Herrmann, Marktleuthen (DE)

(73) Assignee: MEDI GMBH & CO. KG, Bayreuth (DE)

( * ) Notice: Subject to any disclaimer, the term of this patent is extended or adjusted under 35 U.S.C. 154(b) by 626 days.

(21) Appl. No.: 15/253,317

(22) Filed: Aug. 31, 2016

(65) Prior Publication Data

US 2017/0073860 A1 Mar. 16, 2017

(30) Foreign Application Priority Data

Sep. 10, 2015 (DE) ..... 10 2015 115 228.2

(51) Int. Cl.
*D04B 1/24* (2006.01)
*D04B 1/10* (2006.01)
*D04B 1/18* (2006.01)

(52) U.S. Cl.
CPC ..... *D04B 1/243* (2013.01); *D04B 1/108* (2013.01); *D04B 1/18* (2013.01); *D10B 2403/033* (2013.01); *D10B 2403/0332* (2013.01)

(58) Field of Classification Search
CPC ..... D04B 1/243; D04B 1/108; D04B 1/18; D10B 2403/033; D10B 2403/0332
USPC ..... 66/64, 171, 177, 178 A
See application file for complete search history.

(56) References Cited

U.S. PATENT DOCUMENTS 2,016,168 A * 10/1935 Clark ..... D04B 1/18 245/6
2,707,381 A * 5/1955 Lombardi ..... D04B 1/108 66/171
3,092,987 A * 6/1963 Levine ..... A41C 3/06 450/93
3,103,111 A * 9/1963 Rinehart ..... A41D 7/00 66/176
3,241,340 A * 3/1966 Knohl ..... D04B 9/56 66/185

(Continued)

FOREIGN PATENT DOCUMENTS

DE 142900 5/1902
DE 202012004652 U1 8/2010

(Continued)

*Primary Examiner* — Jocelyn Bravo
(74) *Attorney, Agent, or Firm* — Lucas & Mercanti, LLP; Klaus P. Stoffel

(57) ABSTRACT

A flat-knitted material in the form of a pants part comprising the seat for a compression pant, consisting of at least one yarn forming the stitches and an interknitted elastic weft yarn, with an upper base knitted section, to which is adjoined a seat section comprising two adjacent 3-dimensionally curved parts, wherein each 3-dimensionally curved part is formed by several knitted gussets, wherein each gusset comprises several rows of stitches, and the gussets of the one 3-dimensionally curved part is knitted with an offset in the transverse direction of the knitted material from the gussets of the other 3-dimensionally curved part.

17 Claims, 4 Drawing Sheets

(56) References Cited

U.S. PATENT DOCUMENTS

| | | | | | |
|---|---|---|---|---|---|
| 3,283,545 | A | * | 11/1966 | Simon | A41B 9/02 2/403 |
| 3,389,580 | A | * | 6/1968 | Bentley | D04B 1/108 66/176 |
| 3,413,824 | A | | 12/1968 | Kuney | |
| 3,479,844 | A | | 11/1969 | Silvain | |
| 3,748,870 | A | * | 7/1973 | Fregeolle | A41B 11/14 66/177 |
| 3,802,229 | A | * | 4/1974 | Fregeolle | A41B 11/14 66/177 |
| 4,237,707 | A | * | 12/1980 | Safrit | D04B 1/18 66/172 E |
| 6,116,057 | A | * | 9/2000 | Roell | D04B 1/22 66/64 |
| 6,233,976 | B1 | * | 5/2001 | Roell | D04B 1/22 66/64 |
| 2009/0229311 | A1 | | 9/2009 | Obadalova | |

FOREIGN PATENT DOCUMENTS

| | | | |
|---|---|---|---|
| EP | 0905298 | A2 | 3/1999 |
| WO | 2012048344 | A2 | 4/2012 |

* cited by examiner

FLAT-KNITTED MATERIAL IN THE FORM OF A PANTS PART COMPRISING THE SEAT

CROSS-REFERENCE TO RELATED APPLICATIONS

The present application claims priority of DE 10 2015 115 228.2, filed Sep. 10, 2015, the priority of this application is hereby claimed and this application is incorporated herein by reference.

BACKGROUND OF THE INVENTION

The invention pertains to a flat-knitted material in the form of a pants part comprising the seat for a compression pant consisting of at least one knitting yarn forming the stitches and an interknitted elastic weft yarn.

Compression pants of this type are used as part of the lymphologic treatment of the buttocks, for example. It is an article of compressive clothing, which is knitted out of at least one stitch-forming knitting yarn, occasionally of two knitting yarns (one inelastic and one elastic yarn, or two elastic or two inelastic knitting yarns), which cooperate to form the stitches, and an interknitted weft yarn. The pant comprises defined compressive properties, so that the body part in question can be treated by compression. Pants of this type usually consist of at least one pant part in the form of flat-knitted material comprising the seat and a second pant part, also in the form of flat-knitted material, covering the lower abdomen, the edges of the two parts being sewn together, and usually also a sewn-on gusset and possibly two sewn-on leg sections.

The flat-knitted material forming the pant part comprising the seat is knitted with a 3-dimensional curvature, so that the finish-knitted pant part has a slightly hemispherical shape, so that it approximates the anatomy of the buttocks. The pant assembled out the front and rear pant parts is therefore configured with a hemispherical seat or rear side. Although it is possible in this way to obtain an anatomically adapted pant shape, it has been discovered that improving the compressive fit of the pant in the buttocks area would be advantageous both from the standpoint of treatment and from the standpoint of better wearing comfort.

SUMMARY OF THE INVENTION

The invention is therefore based on the problem of providing a flat-knitted material in the form of a pant part comprising the seat, which material represents an improvement over the known solution.

To solve this problem, according to the invention a flat-knitted material in the form of a pant part comprising the seat for a compression pant consisting of at least one stitching yarn forming the stitches and an interknitted elastic weft yarn is provided, with an upper base knitted section, to which is adjoined a seat section comprising two adjacent 3-dimensionally curved parts, wherein each curved part is formed by several knitted gussets, wherein each gusset comprises several rows of stitches, and wherein the gussets of the one curved part are knitted so as to be offset in the transverse direction of the knitted material from the gussets of the other curved part.

In the flat-knitted material according to the invention, it is especially advantageous that two 3-dimensionally curved parts are knitted next to each other; that is, the flat-knitted material comprises two separate, slightly hemispherical, 3-dimensionally curved sections, each of which corresponds to its associated half of the buttocks to be fitted. The flat-knitted material and thus the pant fabricated from it are therefore adapted to the real anatomy in a manner significantly better than that achieved previously. Because each half of the buttocks is accommodated in a separate, 3-dimensionally curved seat section, and because the pant part, i.e., the pant, still has the appropriate compressive properties, the article is therefore much more comfortable to wear, because the pant conforms very effectively to the real anatomy, and a corresponding lymphologic treatment is possible, especially resulting from the circumstance that each half of the buttocks is optimally fitted and can thus be subjected to optimal compression.

So that the two adjacent 3-dimensionally curved parts can be configured properly by the knitting machine, it is provided, as described above, that each curved part is formed by several knitted gussets. A gusset is a more-or-less trapezoidal knitted section, known in itself, which extends over several rows of stitches. To create this shape, the number of needles which perform the knitting is decreased or increased continuously row by row. The result is that a corresponding, geometrically defined section is obtained, wherein, in the case of a continuous, symmetric decrease in the number of needles on both sides, an isosceles trapezoid is formed, although it is also possible that a non-isosceles trapezoid could be produced. According to the invention, a gusset in the area of the one half of the seat is knitted to form the one curved part, and then a gusset is knitted in the area of the other half of the seat to form the other curved part, so that, as the knitting length increases, two rows of gussets are formed, extending in the lengthwise direction of the knitted material, which rows are adjacent to each other when seen in the transverse direction of the knitted material. The gussets of the individual curved part naturally adjoin each other, so that, overall, two separate curved parts are obtained, which join up with each other in the middle. Each curved part accommodates one half of the buttocks, which is thus fitted much more effectively than is the case with the previously known compression pant.

The alternating gusset formation process continues until the flat-knitted material has the desired length, i.e., the length necessary to provide a good fit to the buttocks to be accommodated. Because, of course, the buttocks to be accommodated come in different sizes depending on the wearer, it is necessary to knit appropriately adapted seat sections, i.e., curved parts. This can be easily done by variation of the width or length of the corresponding gussets, i.e., by variation of the number of needles and rows of stitches over which the individual gussets extend in the individual case and also by variation of the number of gussets.

The gussets can, for example, be knitted with the same pattern as the upper base knitted section, but they could also have any other desired type of pattern. The only important point is that, in their totality, they lead to the formation of a 3-dimensionally curved part with the desired shape.

Each gusset, however, should extend over at least four, in particular over at least eight, rows of stitches. The concrete number of rows of stitches and the width of the gussets will be based, as described above, on the shape and size of the buttocks; that is, an optimal fit can be achieved by choosing the size of the gussets appropriately.

The number of stitches forming the gusset in question can, according to the invention, decrease with every second stitch; that is, an appropriate inward offset could be created after every second row of stitches. Alternatively, the reduction in the number of needles, i.e., the inward offset, could occur after every fourth row of stitches. This, too, depends, on the length and width of the curved part to be knitted, i.e., on the geometry of the gusset to be knitted.

The gussets of the one 3-dimensionally curved part and the gussets of the other curved part can, according to a first alternative of the invention, overlap in the middle area of the seat section in the transverse direction of the knitted material. This means that at least a few rows of stitches of the adjacent gussets are joined to each other or merge with each other. In the finished flat-knitted material, therefore, the two curved parts are directly adjacent to each other. The overlap extends over a few needles in the transverse direction of the knitted material; it is present only in the area of the rows where knitting is still being done with a high number of needles.

As an alternative to overlapping gussets, it is also conceivable that, in the seat section, a base knitted section, several stitches wide when seen the transverse direction of the knitted material, is knitted between the gussets. In this alternative of the invention, therefore, the two 3-dimensionally curved parts are knitted so that they are separated geometrically by the base knitted section knitted between them. This base knitted section between the curved parts, which can be 1-2 cm wide, for example, fits the intergluteal cleft, and it is thus able to prevent the seat area of the finished pantyhose from being pulled into the cleft, which is sometimes perceived to be unpleasant by the wearer.

Once the two rows of gussets and thus the curved parts have been knitted, it is then advisable to finish off the knitting by means of a lower knitted section, which adjoins the seat section and which is formed by at least two gussets, which are knitted with an offset to each in the transverse direction of the knitted material and which extend over a larger number of rows of stitches than the gussets in the seat section. Therefore, each of the two 3-dimensionally curved parts is followed by at least two gussets, relatively long when seen in the lengthwise direction of the knitted material, which provide a certain rounding or curving and which serve to form the legs and to ease the transition to the gores. These two gussets can also be knitted with the geometry of an isosceles trapezoid, but preferably they have the geometry of a scalene trapezoid, wherein the shorter side passes through the area of the center of the knitted material, and the longer side extends outwardly toward the edge of the knitted material. As an alternative to the trapezoidal form, an equilateral or nonequilateral triangular form is also conceivable.

A base knitted section several stitches wide when seen in the transverse direction of the knitted material, which section is preferably wider than the base knitted section formed in the seat section, can also be provided between the gussets in this lower knitted section. This additional narrow base knitted section also serves to improve the fit to the given anatomy of the buttocks to be treated.

Although it is obviously conceivable that all of the sections of the flat-knitted material could be knitted with yarn of the same color or that, for example, a white flat-knitted material could be dyed all one color, it is preferable for the seat section to be knitted with a yarn which has a color different from that used to knit the base knitted section and possibly that used for the lower base knitted section. For example, the upper and lower base knitted sections can be knitted with a black yarn, whereas the seat section could be knitted with a red yarn, for example, wherein the colors can be varied in any way desired, of course.

All of the sections are knitted with at least one knitting yarn and one weft yarn. Preferably, however, the stitches are knitted with two knitting yarns (an inelastic knitting yarn and an elastic knitting yarn or two elastic or two inelastic knitting yarns); that is, two knitting yarns are used plus the elastic weft yarn. The knitting yarns which are used can be with or without a wound covering.

In addition to the flat-knitted material, the invention also pertains to a compression pant comprising a flat-knitted material according to one of the preceding claims. The pant also comprises, of course, a front piece of flat-knitted material, which forms the abdomen part, and which is sewn to the previously described rear flat-knitted material according to the invention along the edges. In addition, a preferably knitted or machine-knitted gore is sewn to the front and rear pant parts; and two knitted leg sections, which extend the pant into the thigh region, can also be knitted on. The gore and leg sections can also be flat-knitted material.

The invention also pertains to a method for the production of a flat-knitted material of the type described. The method is characterized in that, first, an upper base knitted section is knitted, to which a seat section comprising two adjacent 3-dimensionally curved parts is knitted, in that several separate gussets are knitted in alternation between the left and right halves of the material, each extending over several rows of stitches, wherein the gussets of the left half of the knitted material and the gussets of the right half each form a 3-dimensionally curved part.

Each gusset is knitted over at least four, especially over at least 8 rows of stitches. The number of rows of stitches is arbitrary; gussets extending over ten or fourteen or more rows of stitches can also be knitted, depending on the shape of the given buttocks to be accommodated.

The number of stitches forming the gusset in question can decrease after every second row; alternatively, it can decrease after every fourth row of stitches; that is, a corresponding inward offset is knitted after every second or every fourth row of stitches.

In the middle area of the seat section, the gussets of the one curved part and the gussets of the other curved part can be knitted in overlapping fashion in the transverse direction of the knitted material, wherein the overlap extends over a few needles in the transverse direction of the knitted material. This means that the gussets adjoin each other more-or-less directly, and, insofar as the rows knitted by multiple needles are concerned, they comprise common, continuous rows of stitches.

As an alternative, the knitting machine can knit a base knitted section several stitches wide when seen in the transverse direction of the knitted material in the seat area between the gussets, this section separating the two rows of gussets and thus also the curved parts from each other.

To finish off the knitting, a lower knitted section can be knitted onto the seat section, in that at least two gussets, which extend over more rows of stitches than the gussets in the seat section do, are knitted on with an offset to each other in the transverse direction of the knitted material. These two gussets (to which a few of the rows of stitches of the base knitted section forming the edge of the material can also be connected) serve to finish off, as it were, the knit material and form a transition to the leg sections to be sewn on and to the gore. Between these two gussets there can also be a base knitted section several stitches wide in the transverse direction of the knitted material, this section preferably being wider than the base knitted section formed in the seat section.

Although, as already described, all of the sections can be knitted with a yarn of the same color, it is also conceivable that the seat section could be knitted with a yarn of a color different from that of the yarn forming the upper base knitted section and possibly from that of the lower base knitted section.

Only one yarn which is inelastic or of low elasticity and which forms the stitches in which the weft yarn is interknitted can be used to knit the individual sections. Preferably, however, two different knitting yarns are used, namely, an inelastic yarn and an elastic yarn or, alternatively, two elastic or two inelastic yarns, which are knitted jointly with each other to form the stitches into which the elastic weft yarn is interknitted. Yarns with or without a wound covering can be used.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
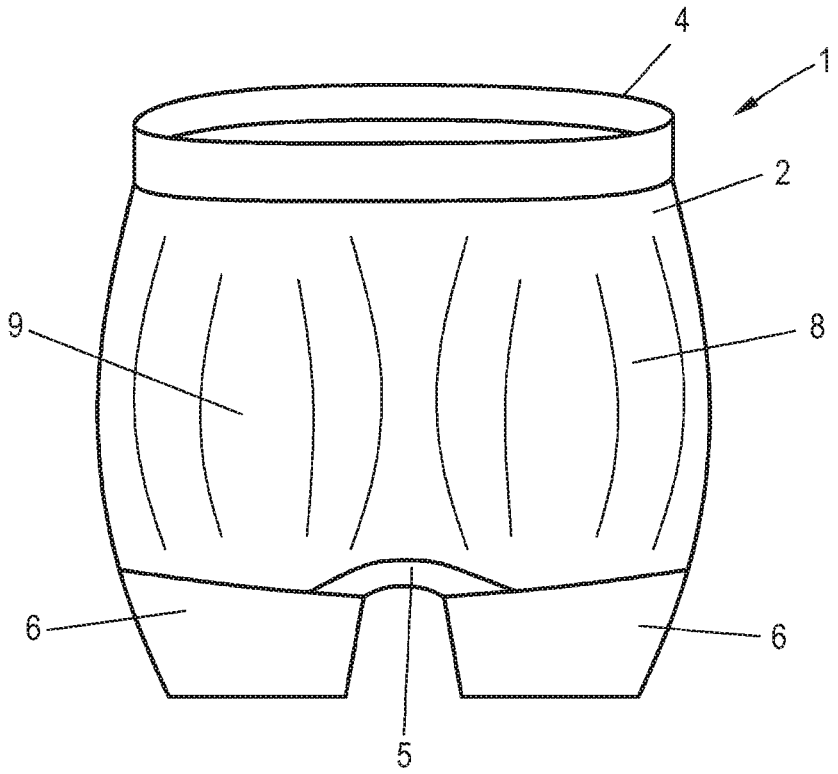
FIG. 1 shows a schematic perspective diagram of a compression pant according to the invention.
Figure 2:
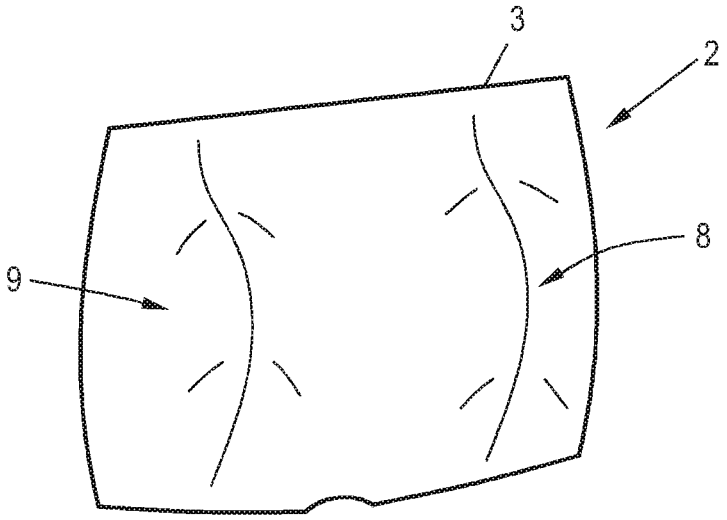
FIG. 2 shows a schematic diagram of a flat-knitted material according to the invention, which forms the rear pant part of the pant of FIG. 1.

FIG. 1 shows a rear view of the compression pant 1 according to the invention, consisting of a pant 2 comprising the seat in the form of a flat-knitted material 3, as shown in FIG. 2, and a front pant part, also of flat-knitted material, forming the abdominal part, not shown in detail here. These two pant parts are sewn together along their edges. At the top an elastic cuff 4 is sewn on, or a knitted-on cuff fold is provided. In the area of the lower end of the pant, a gore 5, preferably also flat-knitted and (optionally) two leg sections 6, also flat-knitted, are sewn to the two pant parts.

Essential to the invention is the pant part 2 comprising the seat, which is described in greater detail below. This part (the same also applies to the other parts which form the compression pant 1 of FIG. 1) is preferably formed out of two knitting yarns, namely, a relatively inelastic yarn and an elastic yarn, the two of which form the stitches, plus an elastic weft yarn laid in the stitches to give the material the desired compressive properties. According to the invention, the flat-knitted material 3 forming the pant part 2 comprises two 3-dimensionally curved parts 8, 9, which are suggested in FIGS. 1 and 2. Two separate 3-dimensionally knitted shapes are realized, which are formed adjacent to each other, wherein each curved part 8, 9 accommodates or holds one half of the buttocks. That is, two more-or-less hemispherical, mirror-symmetric curved parts are formed by the knitting process. This makes it possible for the compression pant to conform more effectively to the actual anatomy of the buttocks and therefore creates the possibility of improved lymphologic treatment and also leads to a significant improvement in wearing comfort.

Figure 3:
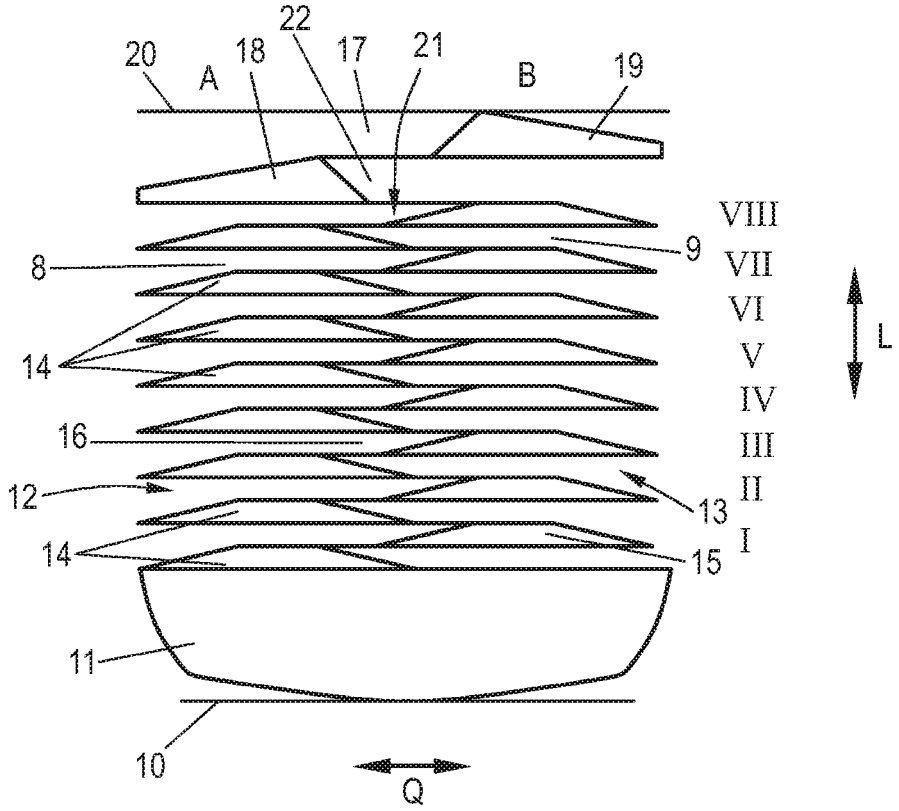
FIG. 3 shows a knitting diagram for the production of a flat-knitted material of a first embodiment in explanation of the production method of this flat-knitted material.

To form these defined curved parts 8, 9 by the knitting process, a gusset technique is used. FIG. 3 shows a knitting diagram, on the basis of which the knitting method for the flat-knitted material 3 of FIG. 2 can be seen.

With respect to the sequence of steps, the knitting diagram is to be read from bottom to top. First to be knitted are a few rows of stitches 10, which form the edge, and to which, first, an upper base knitted section 11 with any desired type of base knitting pattern is knitted. This upper base knitted section 11, as FIG. 3 shows, is knitted with a continuously increasing number of needles in the transverse direction of the knitted material Q, so that it slowly becomes wider in the lengthwise direction L of the material. Of course, the upper base knitted section 11 is knitted directly to the rows of stitches 10 forming the edge. The knitting diagram, as described, defines the sequence of stitches required for the process. Because the base knitted section is knitted first on fewer needles than the needle bed offers, and because the number of needles increases from one row of stitches to the next, the two triangular areas shown in FIG. 3 are obtained between the rows of stitches 10 and the upper base knitted section 11, where it would appear that no stitching is present. In the finished flat-knitted material, however, stitching will obviously be present here; these two sections merely indicate that, at least temporarily, no knitting is being done on the needles present there and that instead the knitting is being done only on needles in the middle area of the needle bed.

Once the upper base knitted section 11 has been finished, the two curved parts 8, 9 start to be formed 3-dimensionally by the knitting process. For this purpose, two separate rows of gussets 12, 13 are knitted, one in the left half A, the other in the right half B. Each gusset row 12 consists of a plurality of individual gussets 14, 15, wherein the gussets 14, 15 of the two gusset rows A, B are adjacent to each other. In the example shown, a total of eight pairs of gussets oriented in the transverse direction Q of the knitted material are obtained, each pair consisting of a gusset 14 and a gusset 15, as indicated by the row numbering I, II, . . . . VII, VIII.

In terms of the knitting process, first a first gusset 14 is knitted in the left half of the material, i.e., in the left machine half of the flat-knitting machine. The first two rows of stitches of the gusset are knitted with a higher needle count, indicated by the section labeling a-a. The needle count is then reduced after every second or every fourth row of stitches; that is, as the number of rows of stitches increases, the number of needles is continuously reduced, until the last rows b-b of stitches are knitted. The needle count therefore decreases continuously as the knitting proceeds from a-a to b-b. The reduction performed in this way and the total number of stitch rows over which the gusset 14 extends are selected as a function of the curvature to be formed, the geometry of which is again selected as a function of the buttocks, i.e., of the size of the half of the buttocks for which the pant part 2 is provided.

Once the gusset 14 is knitted, the first gusset 15 of the second gusset row 13 is knitted on the other half of the machine. This gusset 15 is knitted in the same way as the gusset 14. This means that, first, the knitting is done with a higher needle count of a-a, after which the needle count is reduced after every second or third row of stitches until the minimum needle count corresponding to b-b is reached. The reduction of the needles, i.e., the position of the inward offsets, and the number of rows of stitches over which the gusset 15 extends, are the same as for gusset 14.

The gusset 14 obviously directly adjoins the upper base knitted section 11; in the finished knitted material, the base section lies parallel to the gusset 14. FIG. 3 shows, as described, a knitting diagram, which represents, as it were, the chronological sequence. The time axis extends in the direction of the longitudinal direction L of the knitting. Because the gusset 14 is knitted prior to the gusset 15, the gusset 15 is therefore, in the chronological knitting diagram of FIG. 3, shown a certain distance away from the upper base knitted section 11. In the real knitted material, of course, all of the gussets 14, 15 of the associated gusset rows 12, 13 are linked to each other.

As FIG. 3 shows, the two gussets 14, 15 overlap in the area of the longer rows of stitches. That is, the longer rows of stitches of the individual gussets intermesh with each other. The two gussets 14, 15 of the gusset rows 12, 13 in question are, in the example shown, knitted in the form of more-or-less isosceles trapezoids. Some other geometric form such as scalene trapezoids or the like can obviously be selected also.

Once the first gusset 15 of the second gusset row 13 has been knitted, the second gusset 14 of the first gusset row 12 is knitted in the same way as the first gusset 14; in the chronological knitting diagram of FIG. 3, it is again represented a certain distance away from the first gusset 14, but obviously it is also knitted to that gusset. Once this second gusset 14 is knitted, the second gusset 15 of the second gusset row 13 is knitted, etc., until the last gusset pair, i.e., the last gusset 15 (see the last pair/last gusset designated "VIII") has been knitted. Thus the two 3-dimensionally curved parts 8, 9 have been formed by the knitting process. The two curved parts 8, 9 form in their totality the seat section 16.

A lower base knitted section 17 then follows, which is also formed by two gussets 18, 19, which are knitted in their respective knitted material halves A and B. These two gussets 18, 19, however (see FIG. 3), are somewhat longer than the gussets 14, 15; they have a scalene trapezoidal or triangular geometry. They serve to form a transition to the gore 5 and the leg sections 6, which are to sewn on in this area. The two gussets 18, 19 do not overlap. Between them a central, first base knitted section 22 is formed, which extends over several stitches seen in the transverse direction Q of the knitting.

Figure 4:
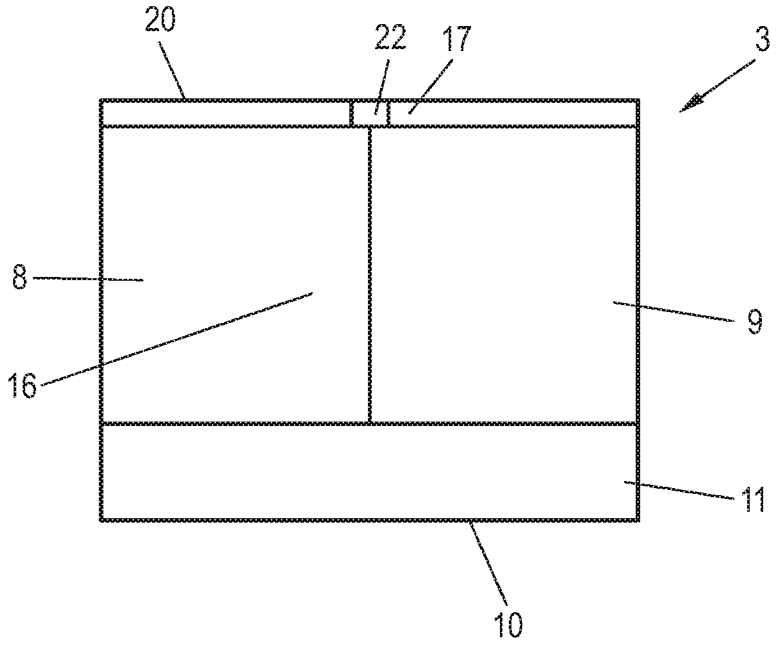
FIG. 4 shows a schematic diagram of the flat-knitted material produced according to the knitting diagram of FIG. 3 in illustration of the essential sections of the flat-knitted material.

The basic schematic structure of the flat-knitted material formed according to this knitting diagram is shown in FIG. 4. What is shown is the upper base knitted section 11 with the edge formed by the rows of stitches 10. Also shown are the two 3-dimensionally curved parts 8, 9, which in their totality form the seat section 16. The gussets 14, 15 forming the curved parts overlap somewhat, as described; this overlap is present in the area of and along the separating line between the two areas representing the curved parts 8, 9. Adjoining this seat section 16 is the lower base knitted section 17, formed by the two gussets 18, 19, which are separated by the central, first base knitted section 22, and by the rows of stitches forming the edge of the knitted material.

Figure 8:
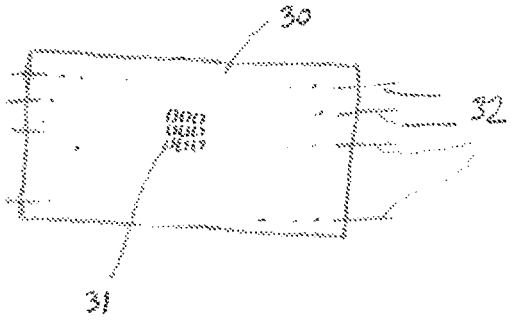
FIG. 8 shows a schematic diagram of a section of a knitted material with weft yarns according to an embodiment of the present invention.

All of the knitted sections include a knitted material 30 made with stitches fiat knitted using at least one knitting yarn 31 (see FIG. 8). The stitches and at least one knitting yarn 31 are shown schematically in FIG. 8 and are not meant to show any specific knitting pattern. The knitted sections also include the elastic weft yarn 32, which is interknitted in the stitches of the knitted material 30, The elastic weft yarn 32 is also shown only schematically in FIG. 8.

Figure 5:
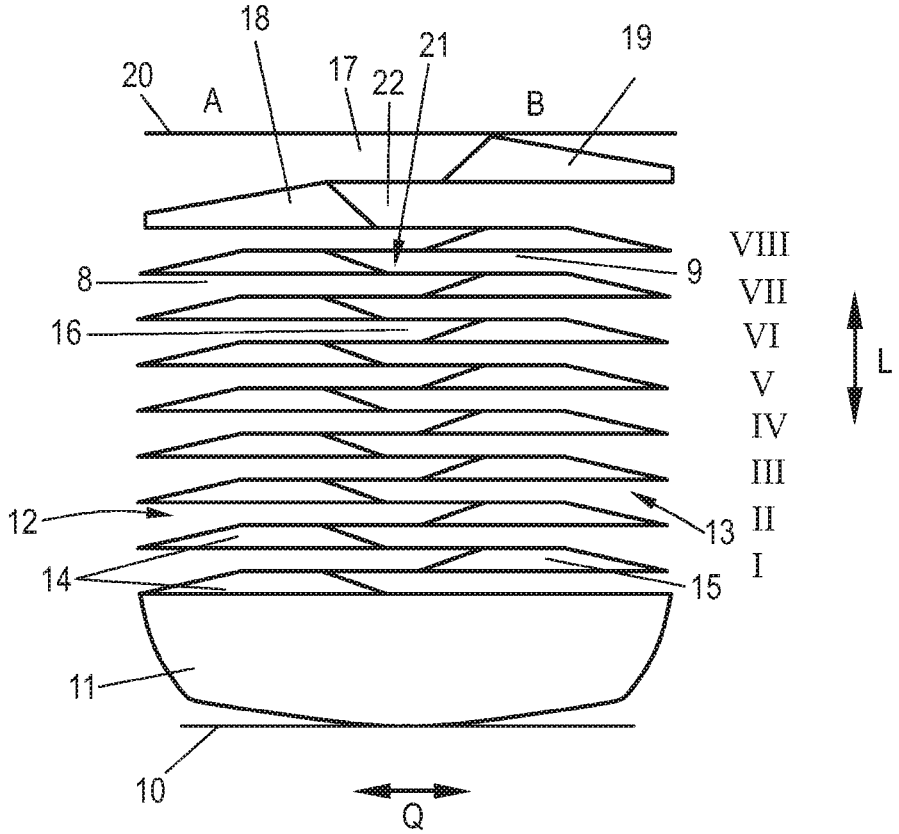
FIG. 5 shows a knitting diagram of a second embodiment for the production of a flat-knitted material in explanation of the production method of this material.

FIG. 5 shows a second knitting diagram for the production of the flat-knitted material 3, which corresponds to the knitting diagram of FIG. 3 in its basic structure. To this extent, the same reference numbers are used for the equivalent elements.

First, a few rows of stitches 10 are knitted here as well to form a knitted edge, to which the upper base knitted section 11 is knitted. Because the knitting diagram here is also chronological, and because the upper base knitted section 11 is intended to have the same type of widening shape, here again the knitting is done initially only in the area of the center needles, wherein, as the number of rows of stitches increases, the number of needles on which the knitting is done is increased. Of course, here again the upper base knitted section 11 is connected to the row of stitches 10.

Once the upper base knitted section 11 is complete, a first gusset 14 of the left gusset row 12 is knitted in the area of the first knitted material half A. Here again, beginning from a-a, knitting is carried out with a continuously decreasing needle count to b-b. The inward offsets can again be realized here, too, after every second or every fourth row of stitches. Once the first gusset 14 of the gusset row 12 has been knitted, the first gusset 15 of the second gusset row 13 on the right is knitted. This, too, is knitted with the same needle count, i.e., a decreasing needle count, and over the same number of rows of stitches from a-a to b-b. Again, of course, the gusset 15 adjoins the upper base knitted section 11, and, of course, all of the gussets of the each of the gusset rows 12, 13 are knitted to each other. The gussets 14, 15 in this example comprise a scalene shape, in contrast to the exemplary embodiment of FIG. 3. Other geometric forms such as an isosceles trapezoid or the like are also obviously conceivable.

Here, however, the two gussets 14, 15 do not overlap; instead, a central, second base knitted section 21, extending over several stitches in the transverse direction of the knitted material Q, is knitted between the two gusset rows 12, 13. The two gusset rows 12, 13 therefore do not adjoin each other directly but are instead separated from each other by the narrow central, second base knitted section 21, which can be 1-2 cm wide, for example. This central, second base knitted section 21 extends over the intergluteal cleft when the pant is being worn. The 3-dimensionally curved parts therefore adjoin this central, second base knitted section 21.

The individual gussets 14, 15 of the two gusset rows 12, 13 are now knitted in alternation until here, too the last gusset pair VIII is complete. The seat section 16 with its two curved parts 8, 9 is thus finished.

A lower knitted section 17, formed by two gussets 18, 19, which are clearly much longer, and which therefore extend over many more rows of stitches, than the gussets 14, 15, is now joined to the seat section 16. These two gussets also comprise a somewhat different geometry and tend more toward the triangular than to the trapezoidal than the gussets 14, 15. The two gussets 18, 19 are also nonoverlapping. Between them a central, first base knitted section 22 is formed, which extends over more stitches in the transverse direction of the knitted material Q than the central, second base knitted section 21 separating the two curved parts 8, 9.

Once the lower base knitted section 17 is finished, the knitted edge is formed by a few rows of stitches 20, after which the flat-knitted material of this embodiment is complete.

Figure 6:
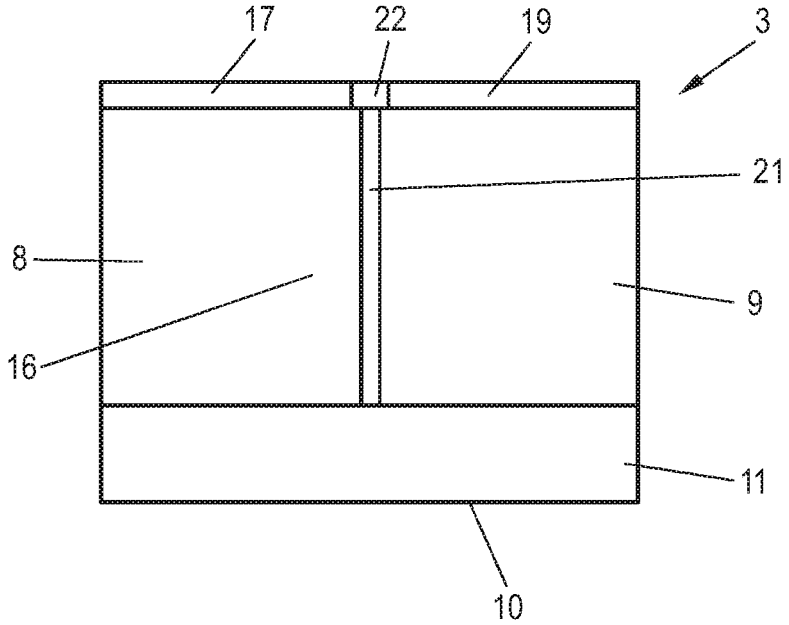
FIG. 6 shows a schematic diagram of a flat-knitted material produced according to the knitting diagram of FIG. 5 in illustration of the essential sections thereof.

FIG. 6 shows a schematic diagram of the structure of the flat-knitted material 3 as knitted according to the knitting diagram of FIG. 5. The upper knitted section 11 with the rows of stitches 10 forming the edge are shown again. Adjoining these is the seat section 16 with the two 3-dimensionally curved parts 8, 9, which are separated in the middle by the central, second base knitted section 21. Adjoining the seat section 16 is then the lower knitted section 17 with the two sections formed by the gussets 18, 19, the two gusset sections being separated by the central, first base knitted section 22.

Figure 7:
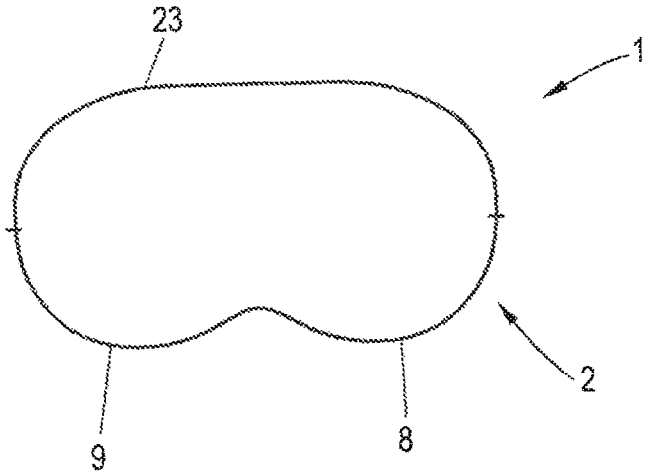
FIG. 7 shows a schematic diagram of a cross-section through the compression pant 1 of FIG. 1 in illustration of the 3-dimensionally curved parts.

FIG. 7, finally, shows a cross-sectional view through the compression pant 1 of FIG. 1, in which the pant part 2 according to the invention, which extends over the buttocks, is shown with its two 3-dimensionally curved parts 8, 9, to which the front pant part 23 is sewn. The curvature of the two curved parts 8, 9 can be seen as well as the constriction in the center, which is formed either in the area of the overlap of the curved parts 8, 9 or by means of the central, second base knitted section 21.

All of the sections of the flat-knitted material 3 in question comprise, as described, compressive properties and are therefore made from one knitting yarn, preferably forming two stitches, and an elastic weft yarn. It is possible to knit all the sections with a knitting yarn of the same color throughout, so that, for example, a black flat-knitted material 3 and a completely black compression pant 1 are obtained. It would also be conceivable, however, that the upper knitted section 11 and the lower knitted section 17 could be knitted with one or two yarns of a first color, whereas the seat section 16, i.e., the curved parts 8, 9, could be made of one or two knitted sections of another color, so that the gussets and the curved parts 8, 9 are also set apart visually by their color. It is also conceivable that variations of the yarn colors could be provided in the area of the gussets as well.

Overall, the flat-knitted material according to the invention, i.e., the compression pant according to the invention, allows a much better fit to the actual anatomy, which is advantageous with respect to the therapeutic purpose of an article of compression clothing of this type, because the two halves of the buttocks are more effectively accommodated, which also results in a significant improvement in wearing comfort.

While specific embodiments of the invention have been shown and described in detail to illustrate the inventive principles, it will be understood that the invention may be embodied otherwise without departing from such principles.

We claim:

1. A flat-knitted material forming a pants part for compression pants, the flat-knitted material including at least one knitting yarn forming stitches and an interknitted elastic weft yarn, the flat-knitted material having an upper base knitted section and a seat section adjoining the upper base knitted section, the seat section comprising two adjacent, slightly hemispherical, 3-dimensionally curved parts, wherein each 3-dimensionally curved part is formed by a plurality of knitted gussets adjoining each other, wherein each gusset comprises a plurality of rows of stitches, each row formed from a number of stitches that is less than a number of stitches forming at least one row of the upper base knitted section, wherein the stitches of the gussets are formed from the at least one knitting yarn, with the elastic weft yarn interknitted in the stitches of the gussets, and the plurality of gussets of one of the two 3-dimensionally curved parts are knitted with an offset in a transverse direction of the knitted material to the plurality of gussets of the other of the two 3-dimensionally curved parts.

2. The flat-knitted material according to claim 1, wherein each gusset extends over at least four rows of stitches.

3. The flat-knitted material according to claim 1, wherein the number of stitches forming each gusset decreases after every second or after every fourth row of stitches.

4. The flat-knitted material according to claim 1, wherein, in a middle area of the seat section, each gusset of the one of the two 3-dimensionally curved parts overlaps one of the gussets of the other of the two 3-dimensionally curved parts in the transverse direction of the knitted material.

5. The flat-knitted material according to claim 1, wherein, in the seat section, a first intermediate base knitted section a plurality of stitches wide in the transverse direction of the knitted material is knitted between the one of the two 3-dimensionally curved parts and the other of the two 3-dimensionally curved parts.

6. The flat-knitted material according to claim 5, wherein a lower base knitted section adjoins the seat section, the lower base knitted section being formed by at least two additional lower gussets knitted with an offset to each other in the transverse direction of the knitted material, wherein a second intermediate base knitted section a plurality of stitches wide in the transverse direction of the knitted material is knitted in the lower base knitted section between the at least two additional lower gussets, the second intermediate base knitted section being wider than the first intermediate base knitted section formed in the seat section.

7. The flat-knitted material according to claim 1, wherein a lower base knitted section adjoins the seat section, the lower base knitted section being formed by at least two additional lower gussets knitted with an offset to each other in the transverse direction of the knitted material, wherein the at least two additional lower gussets extend over more rows of stitches than the gussets in the seat section.

8. The flat-knitted section according to claim 1, wherein the seat section is knitted with a yarn of a color different from that of the at least one knitting yarn forming the upper base knitted section.

9. A pair of compression pants comprising a flat-knitted material according to claim 1.

10. A method for producing a flat-knitted material according to claim 1, wherein, first, the upper base knitted section is knitted, to which the seat section is knitted, wherein the plurality of gussets are knitted alternately in a left half and in a right half of the flat-knitted material, wherein the gussets of the left half of the knitted material adjoin each other and the gussets of the right half of the knitted material adjoin each other, and the gussets of the right half and the gussets of the left half each form one of the 3-dimensionally curved parts.

11. The method according to claim 10, wherein each gusset is knitted at least over four rows of stitches.

12. The method according to claim 10, wherein the number of stitches forming each gusset decreases after every second or every fourth row of stitches.

13. The method according to claim 10, wherein the gussets of one of the two 3-dimensionally curved parts and the gussets of the other of the two 3-dimensionally curved parts are knitted so that the gussets overlap in a middle area of the seat section.

14. The method according to claim 10, wherein, in the seat section, a first intermediate base knitted section a plurality of stitches wide in the transverse direction of the knitted material is knitted between the two 3-dimensionally curved parts.

15. The method according to claim 14, wherein a lower base knitted section is knitted onto the seat section, the lower base knitted section being formed by at least two additional lower gussets knitted with an offset to each other in the transverse direction of the knitted material, and in the lower base knitted section, a second intermediate base knitted section which is a plurality of stitches wide in the transverse direction of the knitted material is knitted between the two 3-dimensionally curved parts and is wider than the first intermediate base knitted section.

16. The method according to claim 10, wherein a lower base knitted section is knitted onto the seat section, the lower base knitted section being formed by at least two additional lower gussets knitted with an offset to each other in the transverse direction of the knitted material, the at least two additional lower gussets extending over more rows of stitches than the gussets in the seat section.

17. The method according to claim 10, wherein the seat section is knitted with a yarn which is of a color different from that of the at least one knitting yarn forming the upper base knitted section.

* * * * *